US010077529B2

(12) United States Patent
Yoon et al.

(10) Patent No.: US 10,077,529 B2
(45) Date of Patent: Sep. 18, 2018

(54) GARMENT PROCESSING APPARATUS

(71) Applicant: LG ELECTRONICS INC., Seoul (KR)

(72) Inventors: Juhan Yoon, Seoul (KR); Seongwoo An, Seoul (KR); Sangho Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/398,023

(22) Filed: Jan. 4, 2017

(65) Prior Publication Data

US 2017/0191215 A1 Jul. 6, 2017

(30) Foreign Application Priority Data

Jan. 5, 2016 (KR) ..... 10-2016-0001193

(51) Int. Cl.
*D06F 58/24* (2006.01)
*D06F 58/20* (2006.01)

(52) U.S. Cl.
CPC ..... *D06F 58/24* (2013.01); *D06F 58/206* (2013.01)

(58) Field of Classification Search
CPC ..... D06F 58/206; D06F 58/24
(Continued)

(56) References Cited

U.S. PATENT DOCUMENTS 654,951 A 7/1900 Cordner
2,742,708 A * 4/1956 McCormick ..... D06F 58/02 34/60
(Continued)

FOREIGN PATENT DOCUMENTS

EP 2 270 274 1/2011
EP 2 436 818 4/2012
(Continued)

OTHER PUBLICATIONS

International Search Report dated Feb. 17, 2017 issued in Application No. PCT/KR2016/012806.
(Continued)

*Primary Examiner* — Stephen M Gravini
(74) *Attorney, Agent, or Firm* — KED & Associates, LLP

(57) ABSTRACT

A garment processing apparatus including: a duct provided at an upper part of a drum, configured to form a flow passage passing through a heat exchanger installed at the inside, and having an inclined bottom surface; a fan motor installed at the duct to move air inside the duct; a condensed water discharge tray provided at a bottom surface of the duct, wherein condensed water generated from air passing through the heat exchanger is collected in the condensed water discharge tray; a drain installed at a lower part of the drum and configured to discharge the condensed water collected in the condensed water discharge tray to the outside; and a condensed water discharge pipe connecting the condensed water discharge tray and the drain to allow the condensed water to flow, wherein the condensed water collected in the condensed water discharge tray prevents a backflow of fluid from the drain tray to the condensed water discharge part through the condensed water discharge pipe caused by a pressure difference generated by a drive of the fan motor.

22 Claims, 13 Drawing Sheets

(58) Field of Classification Search
USPC ..... 34/469, 595–610; 68/5 C, 19
See application file for complete search history.

(56) References Cited

U.S. PATENT DOCUMENTS

| | | | | | |
|---|---|---|---|---|---|
| 2,752,694 | A * | 7/1956 | McCormick | D06F 58/02 | 34/60 |
| 2,957,330 | A * | 10/1960 | Cline | D06F 25/00 | 34/527 |
| 3,206,950 | A * | 9/1965 | Xeros | D06F 43/00 | 210/337 |
| 4,698,507 | A * | 10/1987 | Tator | G01N 17/00 | 250/429 |
| 5,343,632 | A * | 9/1994 | Dinh | F26B 21/086 | 34/507 |
| 7,055,262 | B2 * | 6/2006 | Goldberg | D06F 58/206 | 34/108 |
| 9,803,311 | B2 * | 10/2017 | Lee | D06F 39/02 | |
| 2007/0062513 | A1 * | 3/2007 | Gagas | F24C 15/2021 | 126/299 D |
| 2015/0176195 | A1 * | 6/2015 | Joo | D06F 58/24 | 34/73 |
| 2017/0037562 | A1 * | 2/2017 | Jung | D06F 58/02 | |
| 2017/0138612 | A1 * | 5/2017 | Kaiser | F24D 19/1084 | |
| 2017/0191215 | A1 * | 7/2017 | Yoon | D06F 58/24 | |

FOREIGN PATENT DOCUMENTS

| | | | | |
|---|---|---|---|---|
| EP | 3 015 592 | | 4/2016 | |
| EP | 2889427 | B1 * | 3/2017 | D06F 58/24 |
| JP | H08-5245 | | 1/1996 | |
| JP | 2005-164031 | | 6/2005 | |
| JP | 2010-035894 | | 2/2010 | |
| JP | 2011-000142 | | 1/2011 | |
| JP | 2014-030472 | | 2/2014 | |
| KR | 2014-0095741 | | 8/2014 | |
| KR | 101492986 | B1 * | 2/2015 | D06F 58/24 |
| KR | 2015-0026548 | | 3/2015 | |
| WO | WO 2014/016879 | | 1/2014 | |
| WO | WO 2014/016997 | | 1/2014 | |
| WO | WO 2017119589 | A1 * | 7/2017 | D06F 58/24 |

OTHER PUBLICATIONS

European Search Report dated Mar. 10, 2017 issued in Application No. 16204925.8.

* cited by examiner

GARMENT PROCESSING APPARATUS

CROSS-REFERENCE TO RELATED APPLICATION(S)

Pursuant to 35 U.S.C. § 119(a), this application claims the benefit of earlier filing date and right of priority to Korean Application No. 10-2016-0001193, filed on Jan. 5, 2016, the contents of which is incorporated by reference herein in its entirety.

BACKGROUND

1. Field

A garment processing apparatus that prevents fluid from flowing back through a condensed water discharge pipe is disclosed herein.

2. Background

A garment processing apparatus may remove contamination from laundry by putting clothes, bedding, etc. (hereinafter referred to as laundry) into a drum. The garment processing apparatus may perform processes such as washing, rinsing, dehydration, and drying. The garment processing apparatus may be classified as a top loading type or a front loading type based on a method of loading laundry into the drum. The front loading type washing machine may be generally called a drum washing machine. The garment processing apparatus may generally include a cabinet forming an outer appearance, a tub received in the cabinet, a drum rotatably mounted inside the tub and to receive laundry, and a detergent supply device to supply detergent into the drum.

A garment processing apparatus may have a drying function in addition to a washing function. When washing is completed, it may be possible to evaporate the moisture of the laundry by supplying hot air into the drum. For this, a duct, or a passage through which air is circulated, a heat exchanger installed inside the duct, and a fan motor generating the flow of air may be located at an upper end of the drum in the garment processing apparatus.

As air flows through in the duct, after condensed water is generated from the air passing through the heat exchanger and is collected in the condensed water discharge part, the condensed water may be discharged along the condensed water discharge pipe through a discharge part located at the lower end of the drum. Although there is a description for a conventional apparatus in which condensed water is generated from a heat exchanger in a garment processing apparatus, as for a disclosure relating to a configuration for separately collecting and extracting condensed water as described above, since a condensed water discharge part and a drain part are connected to discharge condensed water generated inside a duct and a fan motor part has a lower pressure than the drain part due to the drive of a fan motor in order for the air flow inside the duct, there may be an issue that air flows backward toward the condensed water discharge part in the drain part.

When air flows backward toward the condensed water discharge part, since air the flows toward the heat exchanger, the efficiency of the heat exchanger may drop. Therefore, unnecessary energy consumption may occur and due to this, vibration, noise and the like may additionally be generated. The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
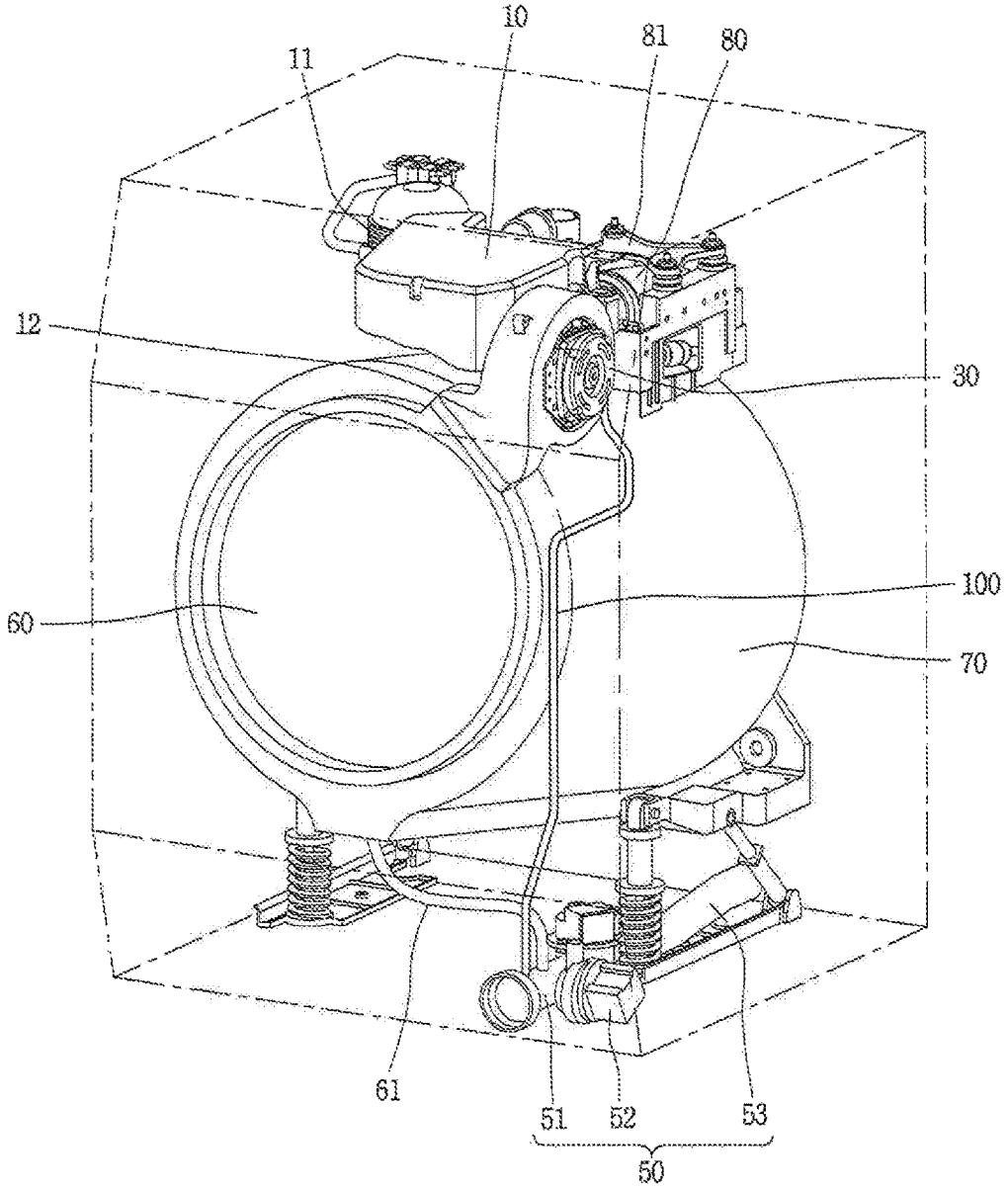
FIG. 1 is a perspective view illustrating the entire structure of a garment processing apparatus.

Referring to FIG. 1, the garment processing apparatus (or laundry machine) may include a main body forming an outer appearance, a tub 70 received inside a cabinet, and a drum 60 rotatably mounted inside the tub 70 to receive laundry. Additionally, since air is required to circulate in order to dry the laundry inside the drum 60, the garment processing apparatus may include a duct 10, a first connection duct 11, a second connection duct 12, a heat exchanger 20, and a fan motor 30, and may include a compressor 80 and a compressor support 81 supporting the compressor 80. Additionally, as air circulates, condensed water 90 may be generated from the air passing through the heat exchanger 20, and in order to discharge the condensed water 90 to the outside, the garment processing apparatus may include a condensed water discharge pipe 100, a drain pump room or compartment 51, a drain pump 52, a drain hose 53, and a drain part connection pipe (or drain connection pipe) 54.

Figure 2:
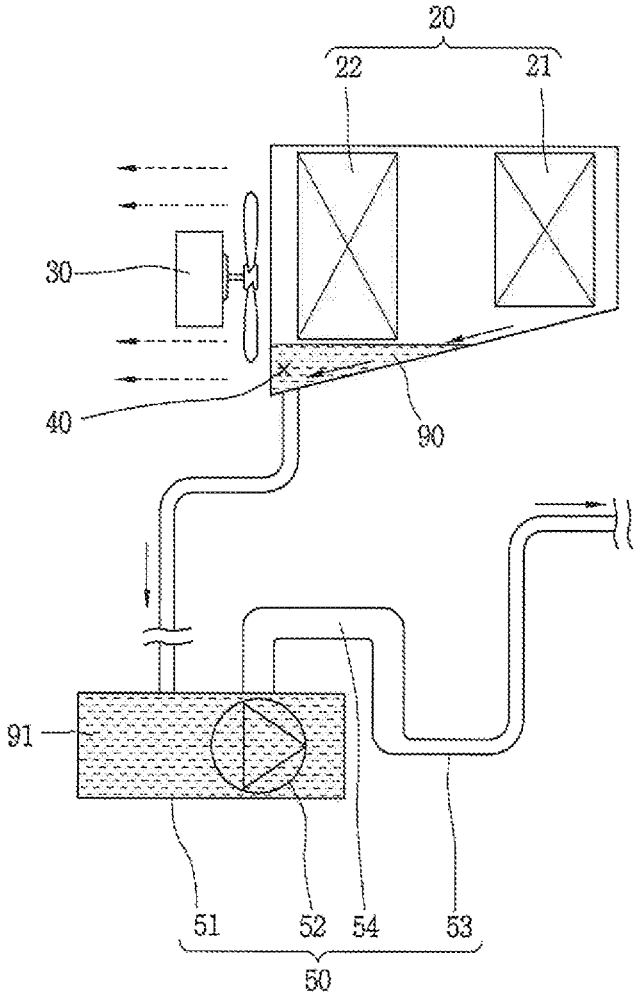
FIG. 2 is a conceptual diagram illustrating the flow of condensed water.

Referring to the FIG. 2, air in the duct 10 may circulate by the drive of the fan motor 30. Since air circulates toward the wing rear of the fan motor 30, it may flow through the heat exchanger 20 including an evaporator 21 and a condenser 22.

A refrigerant passing through the evaporator 21 may absorb heat from the surrounding air. Accordingly, since a surrounding temperature becomes low, moisture in the air passing through the evaporator 21 may be condensed. Therefore, the condensed water 90 may be generated. The condensed water 90 may be collected in a condensed water discharge part or tray 40 located at a relatively lower height than the heat exchange 20 and flow through the condensed water discharge pipe 100 connecting the condensed water discharge part 40 at an upper end and a drain part (or drain) 50 at a lower end.

When the fan motor 30 is driven to circulate air in the duct 10, a portion where the fan motor 30 is driven may generate a relatively low pressure, or negative pressure. As the negative pressure is generated, since the drain part 50 has a relatively higher pressure than the condensed water discharge part 40, a fluid backflow phenomenon that fluid flows along the condensed water discharge pipe 100 from the drain part 50 toward the condensed water discharge part 40 may occur. Herein, fluid may mean air or water and generally means air.

When air flows back toward the condensed water discharge part 40, since the air flows into the heat exchanger 20 located at a portion of the condensed water discharge part 40, this may deteriorate the performance of the heat exchanger 20. Specifically, the air flowing toward the condenser 22 through the condensed water discharge pipe 100 does not pass through the evaporator 21 and thus may have a high humidity state and a relatively high temperature. Thus, this may deteriorate the condensation efficiency of a refrigerant passing through the condenser 22. Accordingly, by preventing the air backflow, the efficiency of the heat exchanger 20 may be maintained and unnecessary power consumption may be prevented.

In FIG. 2, the condensed water 90 generated by the air passing through the heat exchanger 20 by the drive of the fan motor 30 may be collected in the condensed water discharge part 40 and then, the condensed water 90 collected in the condensed water discharge part 40 may flow toward the drain part 50 along the condensed water discharge pipe 100. The condensed water 90 may be temporarily received in the drain pump room 51 in the drain part 50 and pass through the drain part connection pipe 54 by the drain pump 52 to flow outside through the drain hose 53.

As shown in FIG. 2, since the condensed water discharge part 40 is located at one end of an inclined bottom surface of the duct 10, the condensed water 90 generated by the heat exchanger 20 may be collected. Since the condensed water discharge pipe 100 is connected to one end of the condensed water discharge part 40 where the condensed water 90 is received, air may not flow back from the drain pump room 51 through the condensed water discharge pipe 100.

Additionally, since washing water used in the drum 60 of the garment processing apparatus is collected in the drain pump room 51, both the washing water and the condensed water 90 may be received in the drain pump room 51. Since the washing water and the condensed water 90 are received in the drain pump room 51, air may be prevented from flowing toward the condensed water discharge pipe 100 connecting the condensed water discharge part 40 and the drain pump room 51. By The condensed water 90 received in the condensed water discharge part 40 and the washing water 91 and the condensed water 90 received in the drain pump room 51, air may be prevented from flowing back toward the duct 10 through the condensed water discharge pipe 100.

Figure 3:
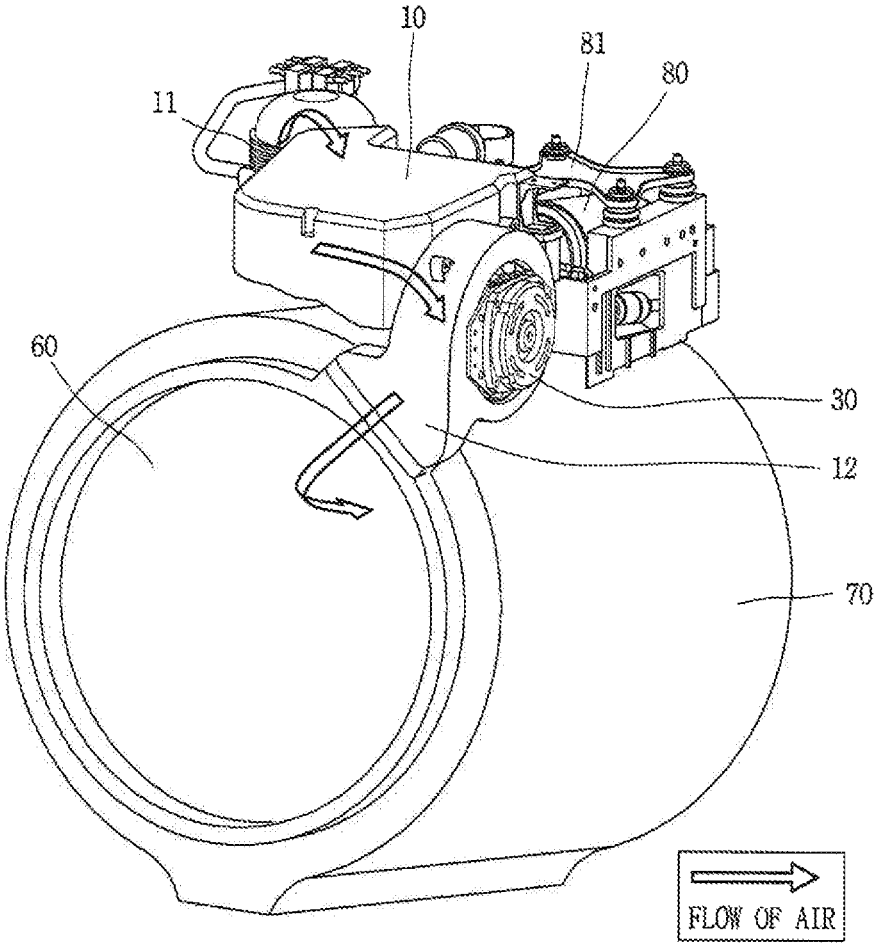
FIG. 3 is a perspective view of a garment processing apparatus illustrating the flow of air therein.

Referring to FIG. 3, the air in the garment processing apparatus may flow from a first connection duct 11 into the drum 60 through a second connection duct 12. In more detail, by the drive of the fan motor 30 provided at the side of the second connection duct 12, air may pass through the evaporator 21 and the compressor 80 in the first connection duct 11 of the duct 10 and flow toward the second connection duct 12. The air passing through the second connection duct 12 may flow into the drum 60 through a gasket connected to the drum 60.

Figure 4:
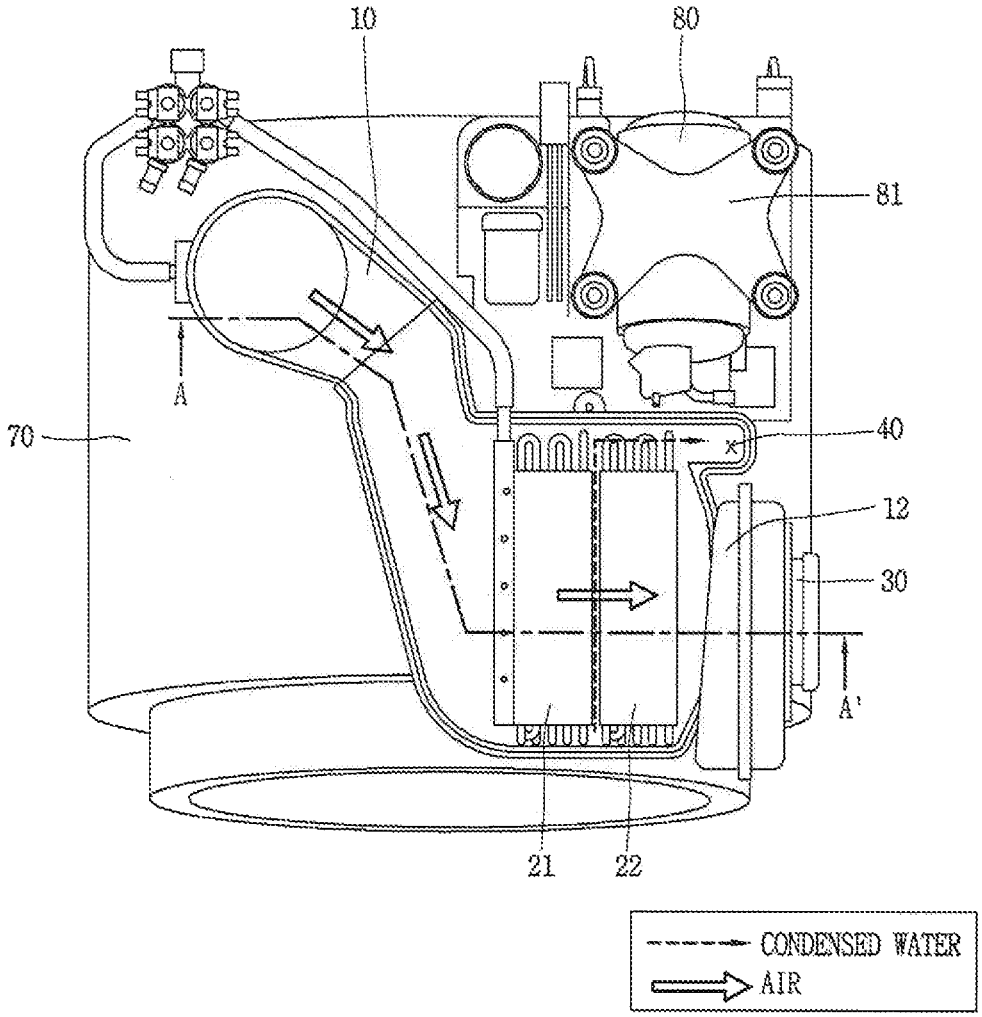
FIG. 4 is a plan view of a garment processing apparatus of FIG. 3 when seen from the top.

Referring to FIG. 4, when looking at the flow of air, air in the duct 10 may flow toward the fan motor 30 by the drive of the fan motor 30. On the drawing, air may flow from the left to the right of the duct 10 by the fan motor 30. When looking at the flow of the condensed water 90, as the fan motor 30 is driven, air passing through the heat exchanger 20 by the flow of air in the duct 10 may sequentially pass through the evaporator 21 and the condenser 22.

The air passing through the evaporator 21 may be condensed as a temperature becomes lower by a refrigerant flowing inside the evaporator 21, so that the condensed water 90 is generated. The condensed water 90 may be collected in the condensed water discharge part 40 having a relatively low height at the lower part of the duct 10 and provided at the bottom surface of the duct 10 and then flow toward the drain part 50 along the condensed water discharge pipe 100.

Figure 5:
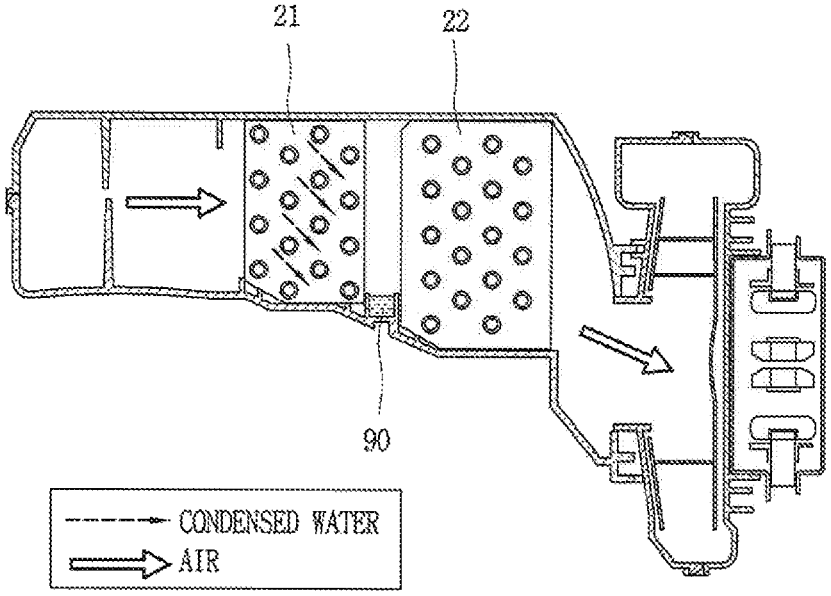
FIG. 5 is a cross-sectional view taken along a line A-A' of a garment processing apparatus of FIG. 4.

Referring to FIG. 5, as the fan motor 30 provided on the right side in the drawing is driven, since the fan motor 30 suctions air, the air may flow from the left to the right. Since a temperature of the air becomes lower as passing through a refrigerant flowing in the evaporator 21, the condensed water 90 may be generated and collected in the condensed water discharge part 40 provided below the duct 10.

Figure 6:
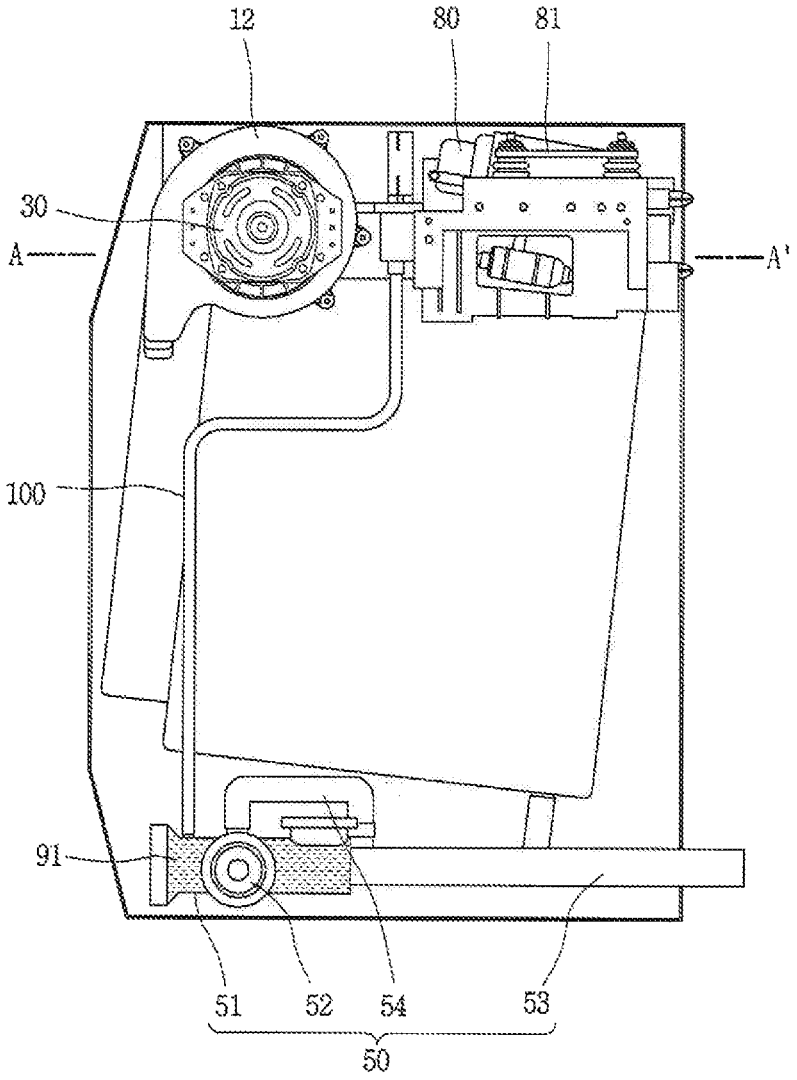
FIG. 6 is a side view of a garment processing apparatus of FIG. 1 when seen from the right side.

Referring to FIG. 6, as air circulates in the garment processing apparatus, in order to discharge the condensed water 90 generated from the air passing through the heat exchanger 20 to the outside, the condensed water discharge pipe 100 connecting the condensed water discharge part 40 and the drain part 50 may be installed. In order to discharge the condensed water 90 to the outside, the garment processing apparatus may include the condensed water discharge pipe 100, the drain pump room 51, the drain pump 52, the drain hose 53, and the drain part connection pipe 54.

The condensed water discharge pipe 100 may connect the condensed water discharge part 40 at the upper end and the drain part 50 at the lower end to provide a passage through which the condensed water 90 flows. The condensed water discharge pipe 100 may be connected to the drain pump room 51 of the drain part 50. The drain part 50 may include the drain pump room 51, the drain pump 52, the drain hose 53, and the drain part connection pipe 54.

Washing water 91 discharged from the drum and the condensed water 90 flowing through the condensed water discharge pipe 100 may be stored in the drain pump room 51. The washing water 91 and the condensed water 90 may be stored in the drain pump room 51 and one end of the condensed water discharge pipe 100 may be connected to the drain pump room 51. Therefore, the backflow of air toward a duct through the condensed water discharge pipe 100 may be limited.

The drain part connection pipe 54 may allow the washing water 91 and the condensed water 90 stored in the drain pump room 51 to flow toward the drain hose 53. The drain part connection pipe 54 may be connected to the upper part of the drain pump room 51. This may allow the washing water 91 and the condensed water 90 to flow toward the drain hose 53 only when power is provided from the drain pump 52.

The drain pump 52 may be installed at the drain pump room 51 and may provide power to allow the washing water 91 and the condensed water 90 stored in the drain pump room 51 to flow toward the drain part connection pipe 54. The shape and structure of the drain pump 52 are not particularly limited. The drain hose 53 may be connected to the drain part connection pipe 54 in order to discharge the washing water 91 and the condensed water 90 to the outside.

Figure 7:
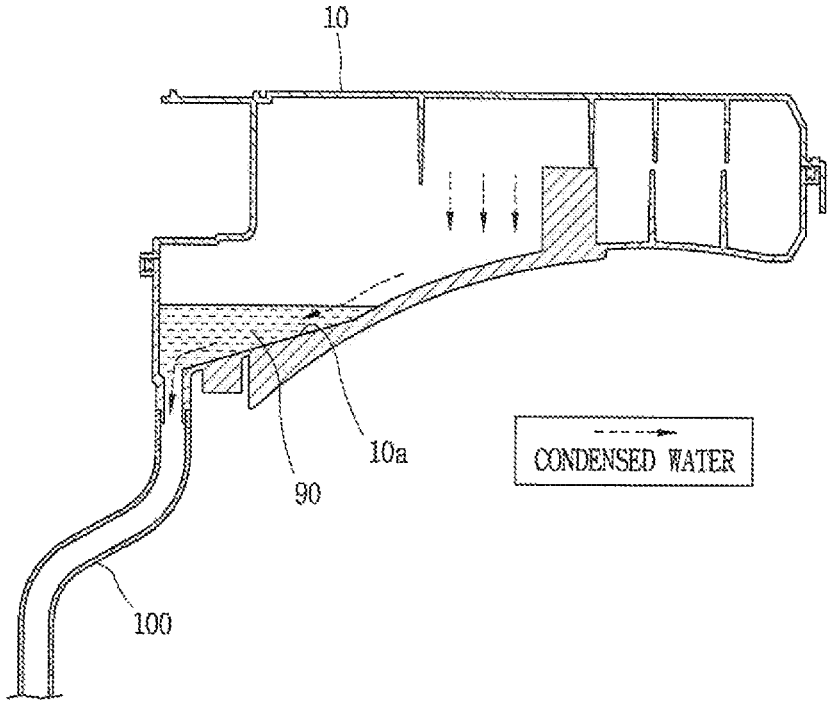
FIG. 7 is a cross-sectional view taken along a line A-A' of FIG. 6.

Referring to FIG. 7, in order to allow the condensed water 90, generated by the heat exchanger 20, to be collected in the duct 10, the condensed water discharge part 40 may be provided at the bottom surface of the duct 10 which may be inclined. In order to discharge the condensed water 90, the condensed water discharge part 40 may be inclined toward the condensed water discharge pipe 100 and provided at one end of the bottom surface of the inclined duct 10*a*. Therefore, the condensed water 90 may be collected.

In order to allow the condensed water 90 to be collected in the condensed water discharge part 40, the condensed water discharge pipe 100 may adjust the amount of the condensed water 90 flowing from the condensed water discharge part 40 toward the condensed water discharge pipe 100 by adjusting the diameter of the condensed water discharge pipe 100. The diameter of the condensed water discharge pipe 100 may be determined through experimentation, and is not limited to a specific value. The diameter of the condensed water discharge pipe 100 may be determined by considering the amount of condensed water 90 receivable in the condensed water discharge part 40 but also considering a value 50 that the height of the condensed water 90 does not increase continuously in the duct 10.

The condensed water 90 may be prevented from flowing back from the drain part 50 to the condensed water discharge part 40 through the condensed water discharge pipe 100 by a pressure difference generated from the drive of the fan motor 30. In FIG. 7, the arrow indicates the movement direction of the condensed water 90.

Figure 8:
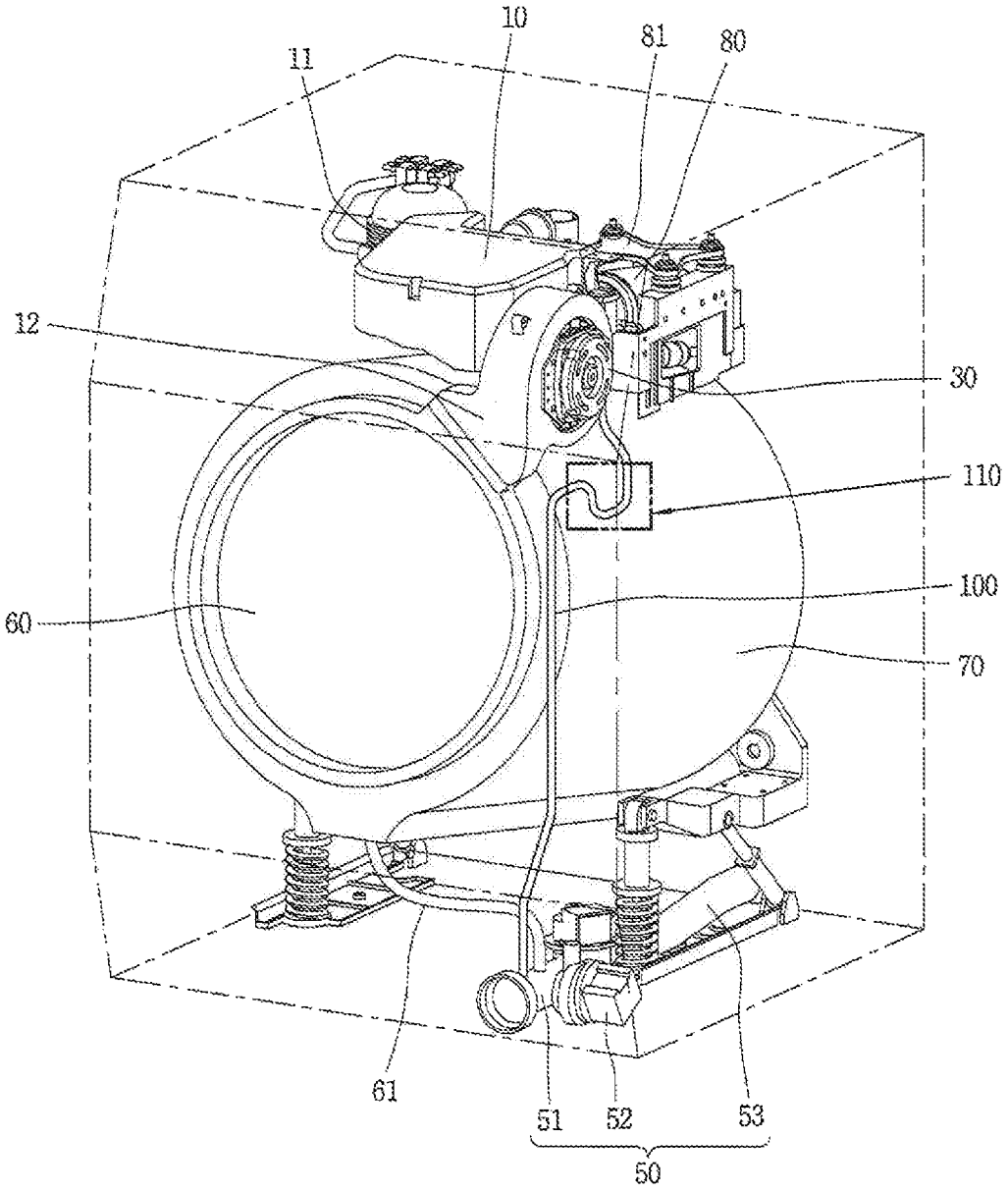
FIG. 8 is a perspective view illustrating the entire structure of a garment processing apparatus including a condensed water discharge pipe with a bent condensed water storage part.
Figure 9:
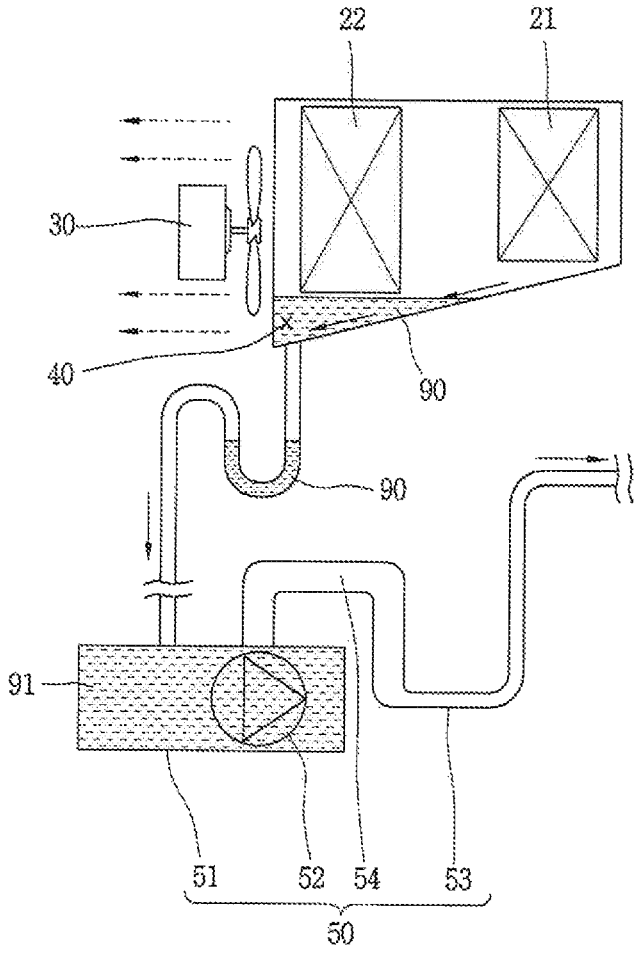
FIG. 9 is a conceptual view illustrating the flow of condensed water in a garment processing apparatus including a condensed water discharge pipe with a bent condensed water storage part.

FIG. 8 is a view illustrating the entire structure of a garment processing apparatus. The configuration shown in FIG. 8 is the same as that shown in FIG. 1. However, unlike FIG. 1, a condensed water discharge pipe is bent to include a condensed water storage part or trap 110 where condensed water may be collected. FIG. 9 is a view illustrating a flow of the condensed water 90 generated by the air passing through the heat exchanger 20 as air circulates in the duct 10.

As shown in FIG. 2, since the condensed water discharge part 40 is provided at one end of an inclined bottom surface of the duct 10, the condensed water 90 generated by the heat exchanger 20 may be collected. Since the condensed water discharge pipe 100 is connected to one end of the condensed water discharge part 40 where the condensed water 90 is received, air may not flow back from the drain pump room 51 through the condensed water discharge pipe 100.

Additionally, since washing water used in the drum 60 of the garment processing apparatus may be collected in the drain pump room 51, both the washing water and the condensed water 90 may be received in the drain pump room 51. Since the washing water and the condensed water 90 may be received in the drain pump room 51, air flowing along the condensed water discharge pipe 100 connecting the condensed water discharge part 40 and the drain pump room 51 may be limited.

Unlike in FIG. 2, referring to FIG. 9, a portion of the condensed water discharge pipe 100 may be bent and the condensed water 90 may be collected therein. The condensed water discharge pipe 100 may have a portion having a bending form and the condensed water 90 may be stored in the portion. Therefore, the portion may be referred to as a condensed water storage part or trap 110. When the condensed water 90, generated as air circulates, flows along the condensed water discharge pipe 100, a portion of the condensed water 90 may be stored in the condensed water storage part 110 that is a bending portion of the condensed water discharge pipe 100, and the backflow of air through the condensed water discharge pipe 100 may be prevented by the condensed water 90 of the condensed water storage part 110.

The garment processing apparatus may drive the fan motor 30 to circulate air and although a pressure of the condensed water discharge part 40 may be relatively lower than that of the drain part 50 due to the drive of the fan motor 30, since the flow of air is limited by the condensed water 90 stored in the condensed water storage part 110, air may not flow along the condensed water discharge pipe 100. With this principle, the backflow of air from the drain part 50 to the condensed water discharge part 40 may be prevented.

Figure 10:
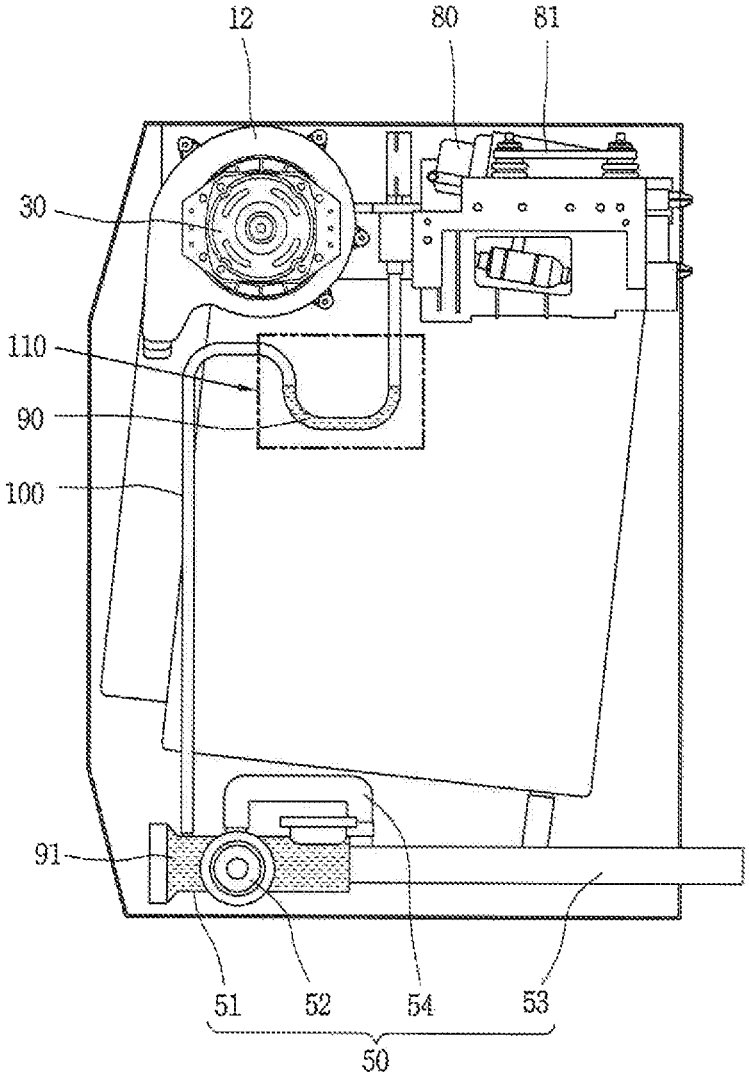
FIG. 10 is a side view of a garment processing apparatus of FIG. 8 when seen from the right side.

As shown in FIG. 10, the condensed water discharge pipe 100 may connect the condensed water discharge part 40 at the upper end and the drain part 50 at the lower end to provide a passage through which the condensed water 90 may flow. The condensed water discharge pipe 100 may be connected to the drain pump room 51 of the drain part 50. The condensed water discharge pipe 100 may be bent to include the condensed water storage part 110 where the condensed water 90 is collected and as shown in FIG. 10, it may be checked that a part of the condensed water 90 is received in the condensed water storage part 110.

Figure 11:
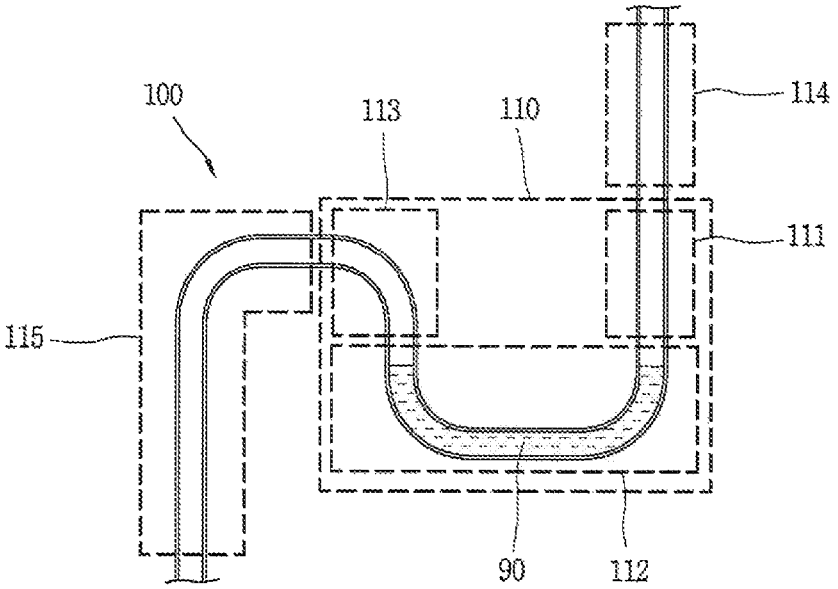
FIG. 11 illustrates a condensed water discharge pipe.

Referring to FIG. 11, the condensed water discharge pipe 100 may be divided into the condensed water storage part 110 where the condensed water 90 is stored and a connection part connected to the condensed water storage part 110. The condensed water storage part 110 may be divided into a first part or portion 111, a second part or portion 112, and a third part or portion 113. The first part 111 may extend from the upper part to the lower part of the condensed water discharge pipe 100; the second part 112 may be bent to be connected to the first part 111 and extend in a direction intersecting the first part 111; and the third part 113 may be bent to be connected to the second part 112 and extend toward the upper part of the condensed water discharge pipe 100.

The first part 111 and the third part 113 may extend in a parallel direction and in order to allow the condensed water 90 flowing along the condensed water discharge pipe 100 to fill the second part 112, the second part 112 may be arranged at a lower height than the first part 111 and the third part 113. When the condensed water 90 is required to be filled to a height higher than a height at which the second part 112 is provided, the backflow of air along the condensed water discharge pipe 100 may be prevented. In relation to the condensed water storage part 110, at least a portion of the second part 112, the first part 111, and the third part 113 may be filled with the condensed water 90.

A connection part of the condensed water discharge pipe 100 may include a first connection part or portion 114 and a second connection part or portion 115. The first connection part 114 may connect the condensed water discharge part 40 and the first part 111 and may extend from the first part 111 toward the condensed water discharge part 40.

The second connection part 115 may connect the third part 113 and the drain part 50 and may be bent at a portion and formed to extend toward the drain part 50. The second connection part 115 may be connected to the third part 113 extending toward the upper part of the condensed water discharge pipe 100 and may be bent at a portion to allow the condensed water 90 to be stored in the condensed water storage part 110.

The first connection part 114 and the second connection part 115 of the condensed water discharge pipe 100 and the condensed water storage part 110 may be formed of different materials. Since the condensed water storage part 110 is required to maintain a U-shaped bending form in order to store the condensed water 90, the condensed water storage part 110 and the condensed water discharge pipe 100 except for the condensed water storage part 110 may be formed of different materials. In general, the condensed water discharge pipe 100 through which the condensed water 90 flows may be formed of a rubber material and the condensed water storage part 110 may be formed of a metallic material in order to maintain the bent form. Additionally, the condensed water storage part 110 formed of a metallic material may be fixed at the inner side surface of the main body or one side of the drum 60.

Figure 12:
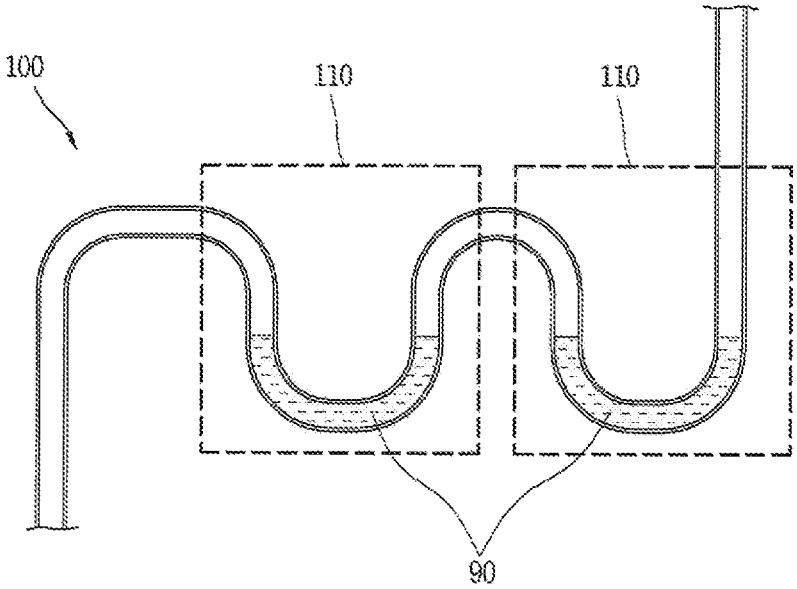
FIG. 12 is a conceptual diagram illustrating that a condensed water storage part is formed at a plurality of places of a condensed water discharge pipe.

Referring to FIG. 12, the condensed water storage part 110 may store the condensed water 90 therein in order to serve to prevent the backflow of air from the drain part 50 toward the condensed water discharge part 40. Multiple condensed water storage parts 110 may be formed at a plurality of places along the length direction of the condensed water discharge pipe 100 and the condensed water 90 may be stored in each condensed water storage part 110. When at least a portion of the second part 112, the first part 111, and the third part 113 of the condensed water storage part 110 may be filled with the condensed water 90, the backflow of air from the drain part 50 toward the condensed water discharge part 40 may be prevented efficiently.

Figure 13:
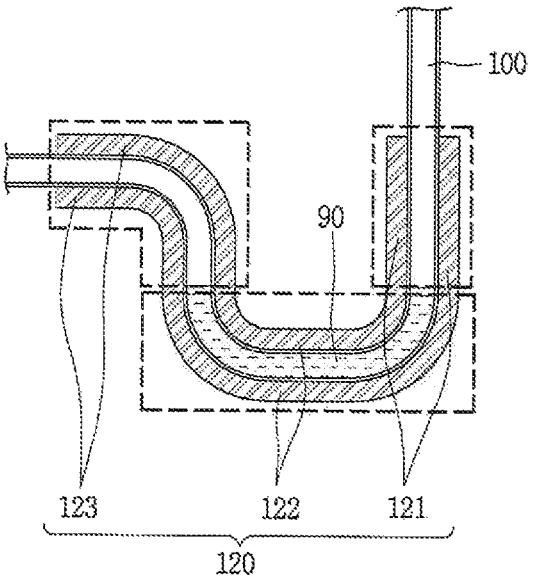
FIG. 13 is a sectional view illustrating that a condensed water discharge pipe support member is disposed at a condensed water storage part.

Referring to FIG. 13, the condensed water discharge pipe support member (or discharge support) 120 may have a form corresponding to the condensed water storage part 110 and may surround at least a portion of the condensed water storage part 110. The condensed water discharge pipe 100 may be formed of a rubber material, and if the condensed water storage part 110 is formed of a rubber material, since it may not be possible to maintain a U-shaped bent form, the condensed water discharge pipe support member 120 may be coupled to the condensed water storage part 110 to maintain the form of the condensed water storage part 110.

The condensed water discharge pipe support member 120 may have a form corresponding to the condensed water storage part 110 or may have a form that surrounds the entirety of the condensed water storage part 110, or surrounds only a portion between the first part 111 and the second part 112 of the condensed water storage part 110 and a portion between the second part 112 and the third part 113 of the condensed water storage part 110. Since the condensed water discharge pipe support member 120 is required to fix the condensed water storage part 110, it may be formed of a plastic or metallic material. The condensed water discharge pipe support member 120 may be formed integrally or may be formed of several coupled components. The condensed water discharge pipe support number 120 may include a first support part (or portion) 121, a second support part (or portion) 122 and third support part (or portion) 123. The condensed water discharge pipe support member 120 may be fixed at the inside of the main body through a bracket or a hook or may be fixed at one side of the drum 60 through a bracket or a hook.

Figure 14:
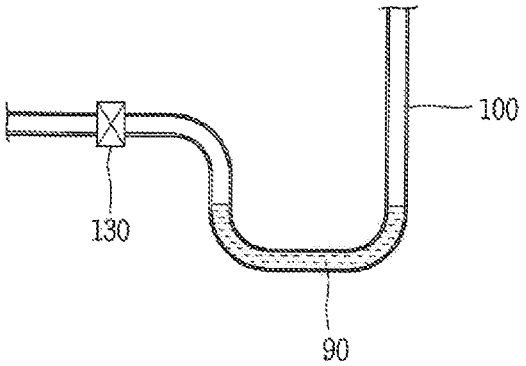
FIG. 14 illustrates that a check valve is disposed at one side of a condensed water discharge pipe.

Referring to FIG. 14, a check valve 130 may be provided at one side of the condensed water discharge pipe 100 to prevent the backflow of air from the drain part 50 toward the heat exchanger 20. Through the check valve 130, the backflow of air from the drain part 50 toward the condensed water discharge part 40 through the condensed water discharge pipe may be prevented. A control unit (or controller) may perform a control on the check valve 130 to be closed only when the condensed water 90 is not discharged.

Figure 15:
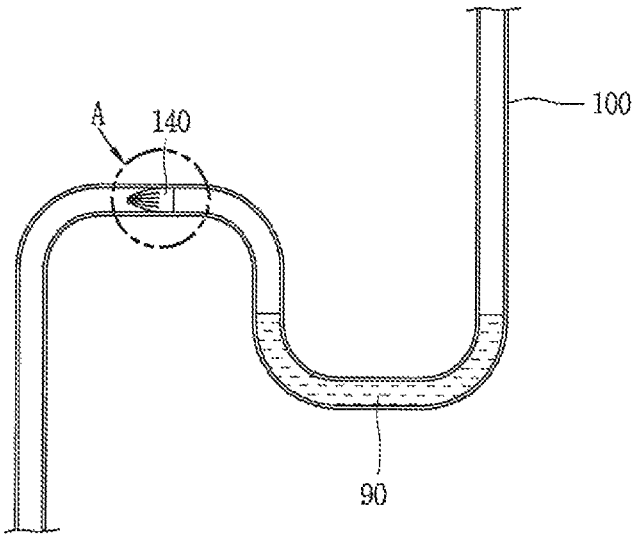
FIG. 15 illustrates that a condensed water discharge adjustment member is disposed inside a condensed water discharge pipe.

Referring to FIG. 15, a condensed water discharge adjustment member 140 may be installed inside the condensed water discharge pipe 100 to allow the condensed water 90 to flow from the condensed water discharge part 40 toward the drain part 50 but limit the flow of air flowing from the drain part 50 toward the condensed water discharge part 40. The condensed water discharge adjustment member 140 may have a tapered form whose section is reduced as it is progressively goes in one direction and may have a structure in which one end part with a small section is widened only in one direction to allow fluid to flow only in one direction. The condensed water discharge adjustment member 140 may be formed of a rubber material and a first end with a wide section may be inserted into the condensed water discharge pipe 100 and serve to restrict fluid not to flow even when the fluid flows. The condensed water discharge adjustment member 140, as shown in FIGS. 15 and 16, may have a form whose section is reduced as it progressively goes toward a downstream part, and the downstream part may be divided into several branches according to the flow of fluid and have elasticity.

Figure 16:
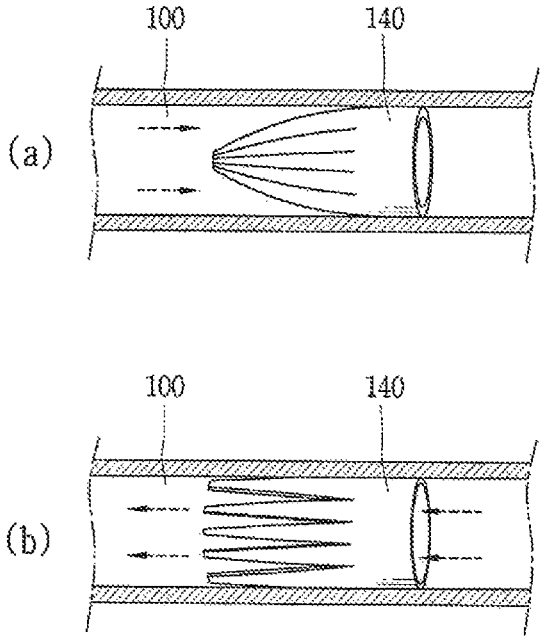
FIG. 16 shows views illustrating that the flow of air from the left to the right of a condensed water discharge pipe is limited by a condensed water discharge adjustment member (shown on top with label (a)); and that the left end of a condensed water discharge adjustment member is opened when condensed water flows from the right to the left of a condensed water discharge pipe (shown on bottom with label (b)).

Referring to FIG. 16 the flow of air from the left to the right of the condensed water discharge pipe 100 may be limited by a condensed water discharge cap. Further, the left end of a condensed water discharge cap may be opened when the condensed water 90 flows from the right to the left of the condensed water discharge pipe 100. Since the condensed water discharge adjustment member 140, as a member having elasticity, has a form whose left end part is pursed normally, as shown in (a), the flow of air flowing from the left to the right of the condensed water discharge pipe 100 is limited. However, as shown in (b), the left end part of the condensed water discharge adjustment member 140 may be opened by the flow of the condensed water flowing from the right to the left of the condensed water discharge pipe 100 and thus, may not limit the flow of the condensed water.

As condensed water is stored in a condensed water discharge part, the backflow of air along the condensed water discharge part may be limited. As a condensed water discharge pipe is connected to one end of a drain pump room for receiving washing water and condensed water, the backflow of air along the condensed water discharge pipe is prevented.

As a condensed water storage part is formed at a condensed water discharge pipe, the backflow of air through the condensed water discharge pipe may be limited. Since the backflow of air toward a heat exchanger may be prevented, the efficiency of the heat exchanger may be improved. As a result, unnecessary energy consumption may be reduced.

A garment processing apparatus may include: a duct disposed at an upper part of a drum, configured to form a flow passage passing through a heat exchanger installed at the inside, and having an inclined bottom surface; a fan motor installed at the duct to move air inside the duct; a condensed water discharge part disposed at a bottom surface of the duct, wherein condensed water generated from air passing through the heat exchanger is collected in the condensed water discharge part; a drain part installed at a lower part of the drum and configured to discharge the condensed water collected in the condensed water discharge part to the outside; and a condensed water discharge pipe connecting the condensed water discharge part and the drain part to allow the condensed water to flow, wherein the condensed water collected in the condensed water discharge part prevents a backflow of fluid from the drain part to the condensed water discharge part through the condensed water discharge pipe by a pressure difference generated by a drive of the fan motor. The condensed water discharge part may be disposed at one end of the inclined bottom surface of the duct to collect the condensed water.

The condensed water discharge part may be inclined toward the condensed water discharge pipe in order to discharge the condensed water. The condensed water discharge pipe may have a diameter value set to adjust an amount of the condensed water flowing from the condensed water discharge part to the condensed water discharge pipe to collect the condensed water in the condensed water discharge part.

The drain part may include: a drain pump room configured to store washing water and the condensed water discharged from the drum; a discharge part connection pipe connected to an upper part of the drain pump room to move the washing water and the condensed water; and a drain hose connected to the drain part connection pipe to discharge the washing water and the condensed water to the outside, wherein a backflow of air from the drain part to the condensed water discharge part is prevented by the washing water and the condensed water stored in the drain pump room. The garment processing may further include a drain pump installed at the drain pump room and configured to provide power for moving the washing water and the condensed water stored in the drain pump room to the drain part connection pipe.

A garment processing apparatus may include a duct disposed at an upper part of a drum, configured to form a flow passage passing through a heat exchanger installed at the inside, and having an inclined bottom surface; a fan motor installed at the duct to move air inside the duct; a condensed water discharge part disposed at a bottom surface of the duct, wherein condensed water generated from air passing through the heat exchanger is collected in the condensed water discharge part; a drain part installed at a lower part of the drum and configured to discharge the condensed water collected in the condensed water discharge part to the outside; and a condensed water discharge pipe connecting the condensed water discharge part and the drain part to allow the condensed water to flow, wherein the condensed water discharge pipe includes a condensed water storage part bent from at least a portion to collect a condensed water in order to prevent air from flowing back from the drain part to the condensed water discharge part by a pressure difference generated by a drive of the fan motor. The condensed water storage part may include: a first part extending downwardly from an upper part of the condensed water discharge pipe; a second part bent to be connected to the first part and extending in a direction intersecting the first part; and a third part bent to be connected to the second part and extending toward the upper part of the condensed water discharge pipe.

The condensed water discharge pipe may further include: a first connection part connecting the condensed water discharge part and the first part; and a second connection part connecting the third part and the drain part, wherein the second connection part may be bent from at least a portion to extend toward the drain part. The first part and the third part may extend in parallel in different directions along a gravity direction.

The condensed water may be filled at a position higher than a position of the second part. The condensed water storage part may be provided at a plurality of places along a length direction of the condensed water discharge pipe.

The garment processing apparatus may further include a condensed water discharge pipe support member having a form corresponding to the condensed water storage part and formed to surround at least a portion of the condensed water storage part. The condensed water discharge pipe support member may be fixed to the inside of the main body or at least one side of a drum.

The condensed water discharge pipe support member may include: a first support part surrounding the outside of the first part in a form corresponding to the first part; a second support part surrounding the outside of the second part in a form corresponding to the second part; and a third part surrounding the outside of the third part in a form corresponding to the third part. The first connection part and the second connection part of the condensed water discharge pipe and the condensed water storage part may be formed of different materials.

The condensed water storage part may be fixed at an inner side surface of the main body. The condensed water storage part may be formed in a U-shaped form. A check valve for limiting air to flow from the drain part toward the heat exchanger may be disposed at one side of the condensed water discharge pipe. The garment processing apparatus may further include a condensed water discharge adjustment member installed inside the condensed water discharge pipe, having a tapered form whose section is reduced as it progressively goes in one direction, and having one end part with a smaller section opened toward a flow direction of fluid.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

In this specification, even in different embodiments, like reference numerals refer to like elements and the description thereof is replaced with the first description. The singular expressions include the plural expressions unless the context clearly dictates otherwise.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A garment processing apparatus comprising:

a duct provided at an upper part of a drum, configured to form a flow passage of air passing through a heat exchanger installed at an inside of the duct to condense water from air passing through the duct, and having an inclined bottom surface, wherein water is condensed from air passing through the heat exchanger;

a fan motor to move air inside the duct;

a condensed water discharge tray to collect condensed water flowing down on the inclined bottom surface provided at a bottom surface of the duct;

a drain provided at a lower part of the drum and configured to discharge the condensed water collected in the condensed water discharge tray to an outside; and a condensed water discharge pipe connecting the condensed water discharge tray and the drain to allow the condensed water to flow from the condensed water discharge tray to the drain, wherein the condensed water collected in the condensed water discharge tray prevents a backflow of fluid from the drain to the condensed water discharge tray through the condensed water discharge pipe caused by a pressure difference generated by the fan motor.

2. The garment processing apparatus of claim 1, wherein the condensed water discharge tray is provided at one end of the inclined bottom surface of the duct to collect the condensed water, and is sloped downward toward the condensed water discharge pipe in order to discharge the condensed water into the condensed water discharge pipe.

3. The garment processing apparatus of claim 1, wherein the condensed water collected in the condensed water discharge tray prevents a backflow of fluid from the drain to the condensed water discharge tray through the condensed water discharge pipe caused by a pressure difference generated by the fan motor.

4. The garment processing apparatus of claim 1, wherein the condensed water discharge pipe has a predetermined diameter set to adjust an amount of the condensed water flowing from the condensed water discharge tray to the condensed water discharge pipe to collect the condensed water in the condensed water discharge tray.

5. The garment processing apparatus of claim 1, wherein the drain includes:

a drain pump compartment configured to store washing water and the condensed water discharged from the drum;

a drain connection pipe connected to an upper part of the drain pump compartment to move the washing water and the condensed water; and a drain hose connected to the drain connection pipe to discharge the washing water and the condensed water to the outside, wherein a backflow of air from the drain to the condensed water discharge tray is prevented by the washing water and the condensed water stored in the drain pump compartment.

6. The garment processing apparatus of claim 5, further including a drain pump installed at the drain pump compartment and configured to provide power to move the washing water and the condensed water stored in the drain pump compartment to the drain connection pipe.

7. The garment processing apparatus of claim 1, wherein the condensed water discharge pipe includes a condensed water storage trap bent at at least a portion of the condensed water discharge pipe to collect condensed water in order to prevent air from flowing back from the drain to the condensed water discharge tray caused by a pressure difference generated by the fan motor.

8. The garment processing apparatus of claim 7, wherein the condensed water storage trap includes:

a first portion extending downward in a first direction from an upper part of the condensed water discharge pipe;

a second portion bent to be connected to the first part and extending in a second direction different the first portion; and a third portion bent to be connected to the second portion and extending toward the upper part of the condensed water discharge pipe.

9. The garment processing apparatus of claim 8, wherein the condensed water discharge pipe further includes:

a first connection portion connecting the condensed water discharge tray and the first portion; and a second connection portion connecting the third portion and the drain, wherein the second connection portion is bent at at least a portion to extend toward the drain.

10. The garment processing apparatus of claim 8, wherein the first portion and the third portion extend in parallel along a gravity direction.

11. The garment processing apparatus of claim 9, wherein the condensed water is filled to a position higher than a lowest point of the second portion.

12. The garment processing apparatus of claim 7, wherein the condensed water storage trap is provided at a plurality of places along a length direction of the condensed water discharge pipe.

13. The garment processing apparatus of claim 7, further including a condensed water discharge pipe support member having a form corresponding to the condensed water storage trap and surrounding at least a portion of the condensed water storage trap.

14. The garment processing apparatus of claim 7, wherein the condensed water discharge pipe support member is fixed to the inside of the main body or at least one side of a drum.

15. The garment processing apparatus of claim 7, wherein the condensed water discharge pipe support member includes:

a first support portion surrounding the outside of the first portion in a form corresponding to the first portion;

a second support portion surrounding the outside of the second portion in a form corresponding to the second portion; and a third portion surrounding the outside of the third portion in a form corresponding to the third portion.

16. The garment processing apparatus of claim 9, wherein the first connection portion and the second connection portion of the condensed water discharge pipe and the condensed water storage trap are formed of different materials.

17. The garment processing apparatus of claim 7, wherein the condensed water storage trap is fixed at an inner side surface of the main body.

18. The garment processing apparatus of claim 7, wherein the condensed water storage trap is formed in a U-shaped form.

19. The garment processing apparatus of claim 1, wherein a check valve limiting air flow from the drain toward the heat exchanger is provided at one side of the condensed water discharge pipe.

20. The garment processing apparatus of claim 1, further including a condensed water discharge adjustment member having a tapered form installed inside the condensed water discharge pipe, wherein a cross-section of a first end of the condensed water discharge adjustment member is larger than a cross-section of a second end, and wherein the condensed water discharge adjustment member allows fluid to flow in only one direction.

21. The garment processing apparatus of claim 1, wherein the condensed water discharge tray is located inside the duct, and the condensed water discharge tray is formed at the end of the inclined surface.

22. A garment processing apparatus, comprising a duct provided at an upper part of a drum, configured to form a flow passage of air passing through a heat exchanger installed at an inside of the duct to condense water from air passing through the duct, and having an inclined bottom surface, wherein water is condensed from air passing through the heat exchanger;

a fan motor to move air inside the duct;

a condensed water discharge tray to collect condensed water flowing down on the inclined bottom surface provided at a bottom surface of the duct;

a drain provided at a lower part of the drum and configured to discharge the condensed water collected in the condensed water discharge tray to an outside; and a condensed water discharge pipe connecting the condensed water discharge tray and the drain to allow the condensed water to flow from the condensed water discharge tray to the drain, wherein the condensed water discharge pipe includes a condensed water storage part including a plurality of bends to collect condensed water, wherein the condensed water discharge pipe has a predetermined diameter value set to adjust an amount of the condensed water flowing from the condensed water discharge tray to the condensed water discharge pipe to collect the condensed water in the condensed water discharge tray.

* * * * *